US006116604A

United States Patent [19]

Vandelli

[11] Patent Number: 6,116,604

[45] Date of Patent: Sep. 12, 2000

[54] WORD TRANSFORMATION GAME

[76] Inventor: Albert Vandelli, 429 Lincoln Blvd., Apt. 1P, Hauppauge, N.Y. 11788

[21] Appl. No.: 09/150,262

[22] Filed: Sep. 9, 1998

[51] Int. Cl.[7] ..... A63F 9/22

[52] U.S. Cl. ..... 273/272; 273/430

[58] Field of Search ..... 273/272, 429, 273/430, 431, 432, 299

[56] References Cited

U.S. PATENT DOCUMENTS 3,746,342 7/1973 Fine .
4,350,342 9/1982 Barulich .
4,438,932 3/1984 Finkel .
4,891,775 1/1990 McWherter .
5,149,103 9/1992 Ross .
5,393,062 2/1995 Cember .
5,860,653 1/1999 Jacobs .

*Primary Examiner*—William M. Pierce
*Attorney, Agent, or Firm*—Martin S. Glass, Esq.

[57] ABSTRACT

An apparatus is provided that is a computer-processor-based word game in which the object is to transform a first word into a second word using the last two letters of the first word as the first two letters of the second word where the second word fits the definition given for that word. The more words correctly transformed, the greater the number of points awarded.

11 Claims, 4 Drawing Sheets

| WORD | DEFINITION |
|---|---|
| TERROR | INTENSE FEAR |
| ORIGIN | BEGINNING |
| INVEST | PROFIT |
| STRIKE | BASEBALL |
| KEEN | WAIL |
| ENDURE | LAST |
| REFER | ALLUDE |
| ERRONEOUS | MISTAKEN |
| USABLE | CONVENIENT |
| LEGION | MANY |

TOTAL: 76

FIG. 3

WORD TRANSFORMATION GAME

BACKGROUND OF THE INVENTION

1. Field of the Invention

This invention relates generally to a computer-processor-based word game and more particularly to a word game in which the object is to transform a first word into a second word using the last two letters of the first word as the first two letters of the second word where the second word fits the definition given for that word.

2. Description of the Related Art

Many word games have been devised using computer processors, game boards and pieces or even pencil and paper. As far back as in 1879, the Reverend Charles L. Dodgson, a.k.a. Lewis Carroll, published a word puzzle he called "Doublets". A Doublet puzzle was a sequence of words, each of the same number of letters, where each word was derived from the previous one by the substitution of one single letter.

Other games included word games wherein players attempt to create known words from randomly selected or provided letters. The creation of words results in a point tally commensurate with the assessed difficulty of creating known words from the selected or provided combination of letters. Probably the most known of these games is Scrabble®, with its wooden letter tiles and tile racks. None of these games use the definitions of the words to aid in solving the puzzle or the next word in the sequence. This allows for multiple correct solutions for the same puzzle.

A need therefore exists for a word game that incorporates the definitions of the words while having the player transform one word to the next.

SUMMARY OF THE INVENTION

In accordance with the principles of the invention, a word transformation game is played by a single person, in which the object of the game is to assemble solutions to the word transformation puzzle based on the word definitions given.

According to one aspect of the present invention, a word transformation game is achieved by displaying a definition on a display of a hand-held electronic game. The player then enters in the word for that definition. If it is correct, he receives points and a new definition is displayed. The player must then solve the next word wherein the last two letters of the previous word are used as the first two letters of the current word, and satisfies the definition displayed. For each correct answer, the player receives additional points.

DESCRIPTION OF THE DRAWINGS

So that one skilled in the art to which the subject invention appertains will better understand how to practice the present invention, preferred embodiments of the apparatus and method will be described in detail hereinbelow with reference to the drawings wherein:

FIG. 2, are a flow chart showing the method of playing the game in accordance with the principles of the present invention, and;

FIG. 3 is a simple realization of the display depicting a sequence of transformations and definitions in accordance with the principles of the present invention.

DETAILED DESCRIPTION OF PREFERRED EMBODIMENTS

Figure 1:
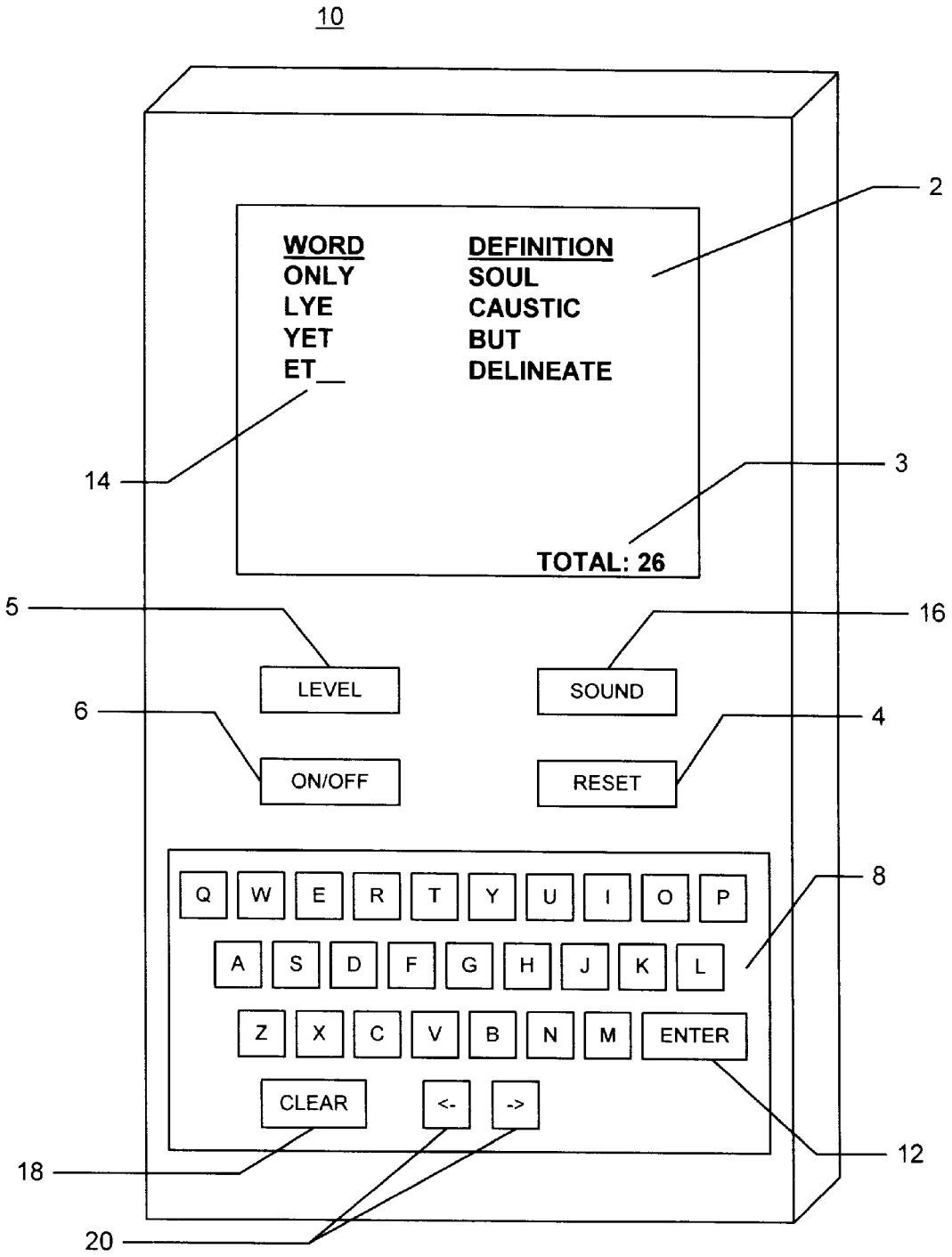
FIG. 1 is a schematic representation of a physical embodiment of the game in accordance with the principles of the present invention.

FIG. 1 shows a first embodiment as a schematic representation of a physical embodiment of the game 10 in accordance with the principles of the present invention. The game 10 is a portable, hand-held device that is microprocessor based.

The display 2 shows a game in mid-play where the microprocessor has displayed the definition "DELINEATE" and the player is in the process of entering a word 14. This word is a transformation from the prior word such that the first two letters "ET" are the last two letters of the prior word, "YET". The device itself is powered on and off via a pushbutton 6. At any time, the player can reset the device to begin a new game by depressing the RESET pushbutton 4. As the player correctly enters the transformed words, points are awarded and a total 3 is maintained and displayed. As an added feature, the game can have sounds to enhance the enjoyment. These sounds can be toggled on and off by alternately depressing the SOUND pushbutton 16. Sounds can include, for example, beeps for each pushbutton depressed, jingles for tallying up the score and a tune when the correct word entered.

The level of difficulty can be altered by depressing the LEVEL pushbutton 5. Each time the pushbutton is depressed, the level increases. The levels can range, for example, from 1 to 5, where 5 is the most difficult. The levels will, for example, increase the number of words in the series, increase the length of the words and/or decrease the number of chances the player has in correctly transforming the word.

The player enters a word by typing it in on the keyboard 8 and then depressing the ENTER pushbutton 12. If the player makes a mistake, he can either depress the CLEAR pushbutton 18 or move the cursor to the right or left via the appropriate arrow pushbuttons 20. Any subsequent typing will overwrite the letters previously typed. The microprocessor will not evaluate the players answer until the ENTER pushbutton 12 is depressed.

As an alternative, the game can be played on a typical desktop computer. The software would be loaded into the computer and then subsequently run by the user to play the game. The arrow keys on the typical computer keyboard would be used, as well as the Enter and Delete keys. The other options, such as sound and level of play can be menu driven. The display would be the same as the display on the hand-held version.

Figure 2A:
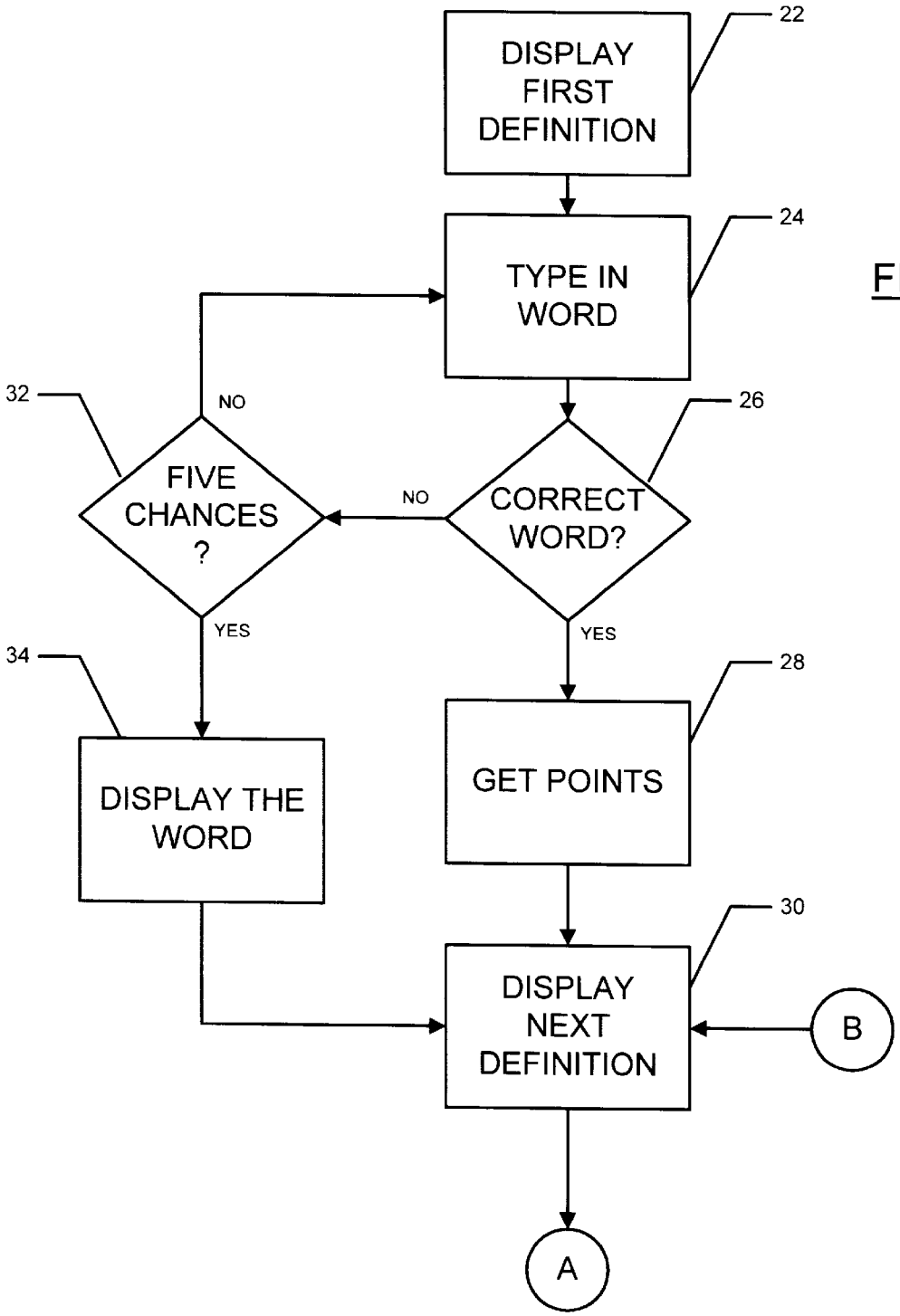
FIG. 2*a* and FIG. 2*b,* taken together to form
Figure 2B:
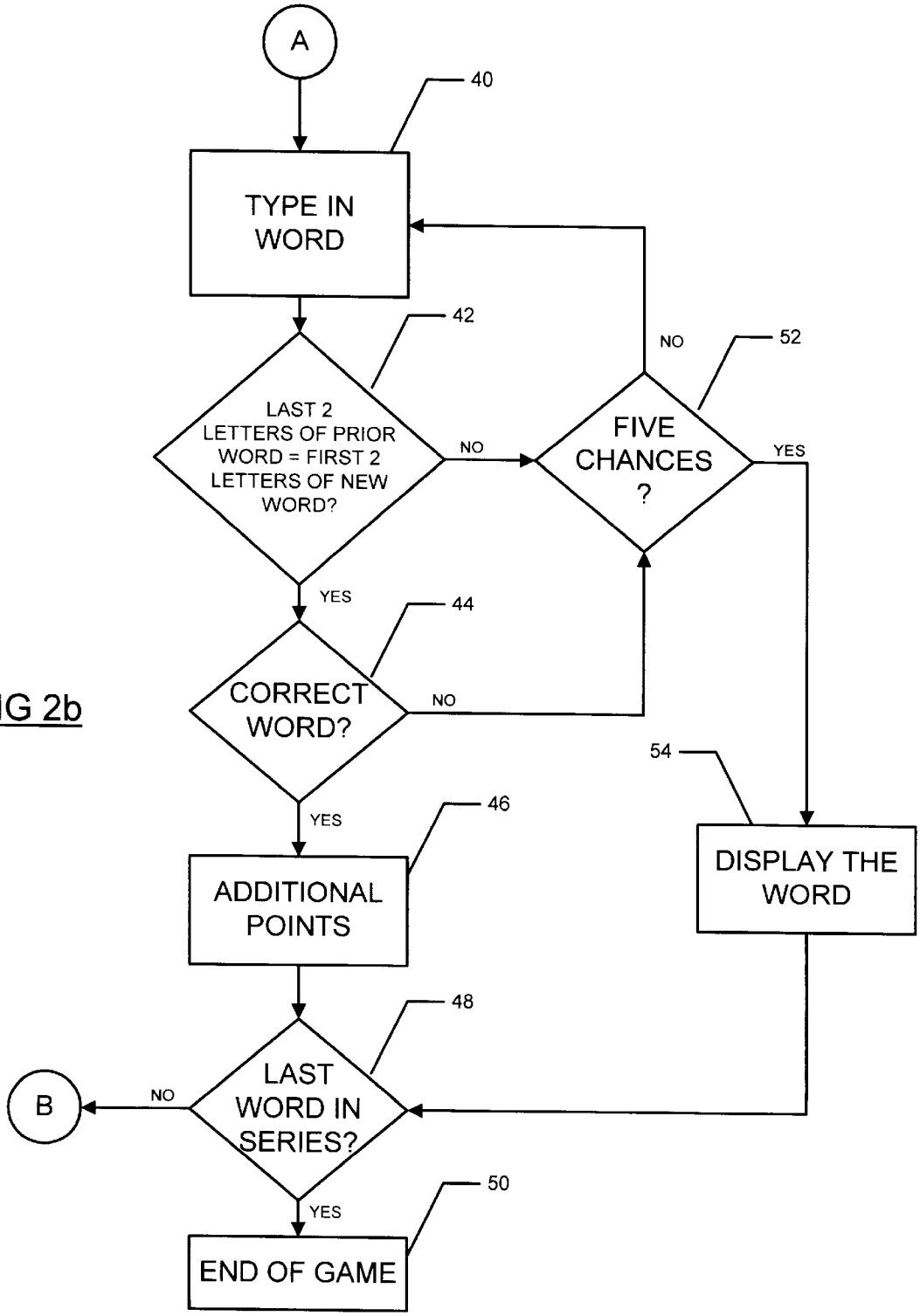

FIG. 2*a* and FIG. 2*b,* taken together to form FIG. 2, show a flow chart depicting the method of playing the game in accordance with the principles of the present invention.

Play begins with the processor displaying the definition of the first word 22. The player then has to type in what word he believes matches the definition 24. If the processor determines that the typed word is correct 26, it will award points 28 depending upon how many tries the player tried. If the word is not correct 26, the processor will ascertain how many tries the player has used. In this example, the processor allows the player five chances 32 to type in the correct word. The number of chances the player is allowed can be changeable by the player depending upon the level of difficulty.

Once the player has used up all his chances, the processor will display the word 34 so that the player knows what the last two letters are in the missed word.

At this point, whether or not the word was correctly identified, the processor now displays the next definition 30. The player must now type in a word 40 using the last two letters of the previous word as the first two letters of the current word. This current word must match the definition given by the processor.

If the first two letters do not match the previous word's last two letters 42, or the current word does not match the definition given 44, the processor will ascertain how many tries the player has used 52. Again, in this example, the processor allows the player five tries to correctly transform the previous word. Each missed chance will reduce the amount of additional points the player receives.

Once the player exceeds the number of chances, the processor will display the missed word 54. A typical game will have ten words in a series, but any number can be used. This may also be a function of the level of difficulty of the game. If this is not the last word in the series, the processor then goes and displays the definition 30 for the next transformation word.

FIG. 3 is a simple realization of the display depicting a completed sequence of transformations and definitions in accordance with the principles of the present invention. In this instance there are ten words in the sequence. The player has accumulated a total of 76 points. This score will vary depending upon how many tries the player used to determine the various transformations.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. An apparatus for playing a word transformation game, comprising:

a definition of a first word from a plurality of words;

an input means for a player to input a first inputted word;

a processing means to determine whether first inputted word is correct word being defined by said definition of said first word;

a definition of a second word from said plurality of words;

a second inputted word by said input means, wherein said processing means determines whether second inputted word is said second word being defined by said definition of said second word, and wherein said second word is a transformation of said first word with the last two letters of said first word being the first two letters of said second word; and a display means to display said first word said definition of said first word, said second word, said definition of said second word, said inputted first word and said inputted second word.

2. The word transformation game of claim 1, wherein said game is played on a computer.

3. The word transformation game of claim 1, wherein points are awarded for each inputted word correctly transformed matching said definition.

4. The word transformation game of claim 2, wherein said computer further comprises a memory for storing said plurality of words and definitions associated with said plurality of words.

5. The word transformation game of claim 4, wherein said computer further comprises a processor for determining the next transformed word from said plurality of words.

6. The word transformation game of claim 3, wherein said computer further comprises a memory for storing said plurality of words and definitions associated with said words.

7. The word transformation game of claim 6, wherein said computer further comprises a processor for determining a next transformed word from said plurality of words and displaying said associated definition of said next transformed word on said display means.

8. The word transformation game of claim 3, wherein said input means is a computer keyboard.

9. A method of playing a word transformation game, comprising the steps of:

defining a first word from a plurality of words;

identifying said first word based on said definition;

defining a second word from said plurality of words, wherein said second word is a transformation of said first word with the last two letters of said first word being the first two letters of said second word;

identifying said second word based on said definition; and awarding and recording points based on the number of correctly identified transformed words.

10. The method of claim 9, wherein said plurality of words and associated definitions are stored in an electronic database.

11. The method of claim 9, wherein said points are recorded in a tabular electronic database.

* * * * *